US006640673B1

(12) United States Patent
Ploeger et al.

(10) Patent No.: US 6,640,673 B1
(45) Date of Patent: Nov. 4, 2003

(54) SPARK PLUG TUBE REMOVER

(75) Inventors: Randall J. Ploeger, Clarinda, IA (US); Gordon Guoli, Mecca, IN (US); Andrew Beck, Winston Salem, NC (US)

(73) Assignee: Lisle Corporation, Clarinda, IA (US)

( * ) Notice: Subject to any disclaimer, the term of this patent is extended or adjusted under 35 U.S.C. 154(b) by 43 days.

(21) Appl. No.: 09/965,925

(22) Filed: Sep. 28, 2001

(Under 37 CFR 1.47)

(51) Int. Cl.[7] ..... B25B 23/10
(52) U.S. Cl. ..... 81/447; 29/263
(58) Field of Search ..... 81/442–447; 29/263; 254/104; 269/48.1

(56) References Cited

U.S. PATENT DOCUMENTS 1,470,421 A * 10/1923 Astley ..... 81/447
2,687,322 A * 8/1954 Am Rhein ..... 81/444
6,435,064 B1 * 8/2002 Persechino ..... 81/442

OTHER PUBLICATIONS

Assenmacher Specialty tools Catalog, 1998, product No. TOY 150, p. 93.
Assenmacher Specialty Tools, Inc. (New Tools Catalog), Aug. 1998, product No. 7008.
Invention Disclosure Agreement Notice, signed by Andrew L. Beck, dated Jan. 22, 1991.
Invention Disclosure Agreement Notice, signed by Gordon Guoli, dated Aug. 3, 2000.

* cited by examiner

*Primary Examiner*—James G. Smith
(74) *Attorney, Agent, or Firm*—Banner & Witcoff, Ltd.

(57) ABSTRACT

A spark plug tube removal tool includes a cylindrical body member and an attached wedge member which may be driven by a bolt against the body member to alter the effective diameter of the tool upon insertion into a spark plug tube so as to wedge the tool within the tube and permit removal of the tube from an engine by turning or working the tool engine block.

7 Claims, 2 Drawing Sheets

SPARK PLUG TUBE REMOVER

BACKGROUND OF THE INVENTION

In a principal aspect the present invention relates to a tool used to remove the protective cylindrical, spark plug tube incorporated in internal combustion engines for various vehicles and a method for use of such a tool.

In some internal combustion engines the spark plugs are located in a tube, which extends through the engine valve cover over the head or engine block. The tube provides access to the spark plugs through the valve cover and protects the spark plug from contamination by fluid such as oil escaping from within the valve cover. Nonetheless, oil may leak into the tube and cause misfiring of the spark plug. In such a circumstance, the tube must typically be removed and replaced in order to effect an appropriate, protective seal about the spark plug. Various Toyota vehicle brand products as well as various Chrysler brand products utilize such an engine construction wherein the spark plug is housed within a tube that passes through the engine valve cover.

Tools have been proposed for engaging and removing the protective spark plug tube. However there has remained a need to provide an improved tube remover tool which is capable of removing tubes of various diameters effectively and economically and to facilitate tube replacement.

SUMMARY OF THE INVENTION

Briefly the present invention comprises a spark plug tube removal tool and a method of using such a tool. The tool is comprised of a generally cylindrical body member which has an axial throughbore adapted to receive a threaded bolt extending longitudinally through the throughbore. The distal end of the body member has an inclined or wedge shaped face. A wedge member with an inclined face is positioned in opposed array to the inclined face of the body member. The threaded end of the bolt extends through the body member and is threaded into the separate wedge member. When the bolt is screwed or turned in the wedge member, the wedge member slides laterally on the inclined end or face of the body member to effectively increase the diameter of the tool. Thus when the tube remover is inserted into a tube and the bolt is turned, the wedge member tightly engages one side of the tube as the body member engages the opposite side and together they become locked in the tube. The tool and tube may then be rotated to unthread or unscrew the protective tube from the engine block or head. Reversal of the process permits replacement of the protective tube by means of the tool.

Among the features which enable the tool to be used effectively and efficiently is the feature of having the diameter of the throughbore in the body member greater than the diameter of the bolt. Also, a polygonal topside or outside end of the body member permits effective gripping and rotation thereof by a wrench or pliers. The use of a headed bolt facilitates turning or tightening of the bolt and lateral movement of the wedge member relative to the body member for engagement with the spark plug tube. A stop washer or lug on the body member limits the extent of insertion of the tool into the protective spark plug tube.

Thus it is an object of the invention to provide an improved tool for removal of spark plug tubes from an engine.

It is a further object of the invention to provide a spark plug tube removal tool comprised of a minimum number of parts, which is economical to manufacture, inexpensive, easy to use and which, when used, will effectively and efficiently remove and/or replace a spark plug tube without rupturing or damaging the tube.

These and other objects, advantages and features of the invention will be set forth in the detailed description which follows.

BRIEF DESCRIPTION OF THE DRAWING

In the detailed description that follows, reference will be made to the drawing comprised of the following figures.

DESCRIPTION OF THE PREFERRED EMBODIMENT

Figure 1:
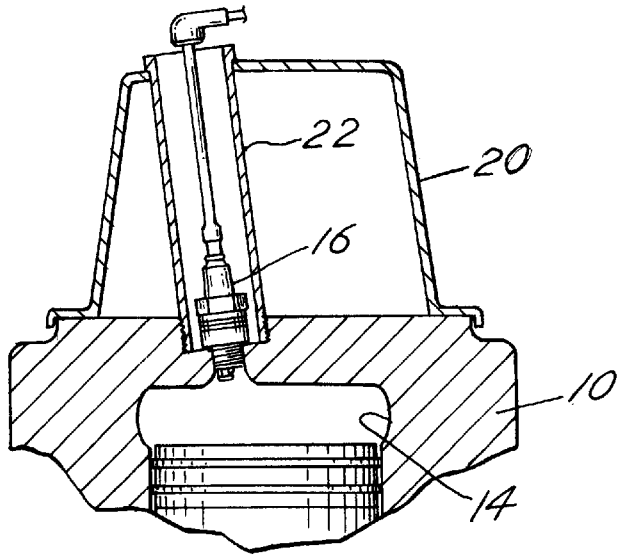
FIG. 1 is a diagrammatic view illustrating the use of a spark plug tube in a typical internal combustion engine wherein the tube projects through a valve cover and connects to an engine head so as to surround and protect the spark plug.

FIG. 1 illustrates a typical environment for the tool of the invention. Thus, an internal combustion engine includes a head or engine block 10, with a valve cover 20 mounted over the cylinder 14. A spark plug 16 is threaded into the head 10 and provides a controlled spark to the cylinder 14. The head 10 supports the valve cover 20. A spark plug 16, which projects upwardly from the head 10 is protected by a spark plug tube 22 threaded into the head 10 and projecting upwardly through the valve cover 20. It is necessary, on occasion, to replace the spark plug tube 22 by gripping it in some manner and rotating it so as to unthread or otherwise remove it from engagement with the head 10. Replacement is effected by reversal of the described operation.

Figure 2:
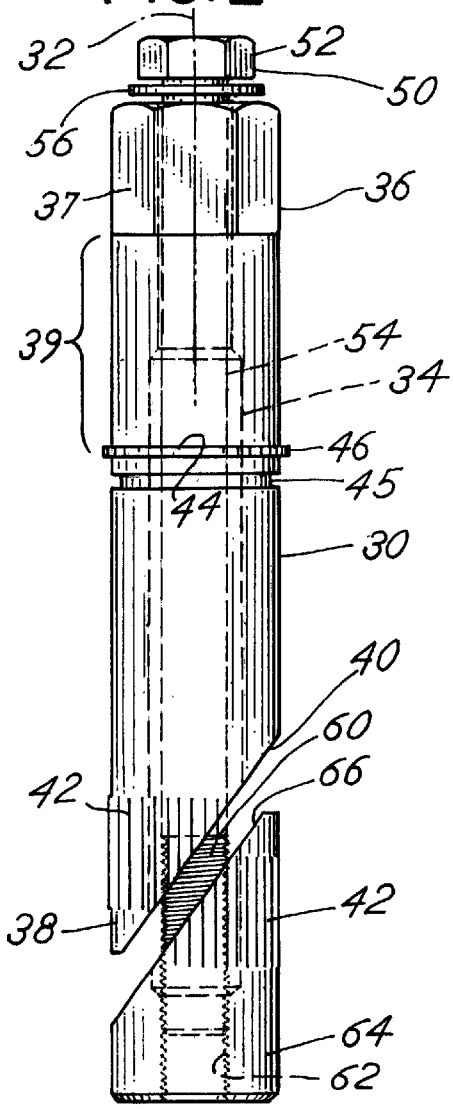
FIG. 2 is a plan view of the tool of the invention.

The tool of the invention is illustrated in FIG. 2 and comprises a series of separate component parts including a main, cylindrical body member 30 having a longitudinal axis 32 and an axial throughbore 34. The body member 30 further includes a top end 36 and a lower end 38 having a planar surface 40 inclined to axis 32. A knurl pattern 42 is defined on the lower outside surface of bottom end 38. The upper end 36 of body member 30 has a polygonal shape and, in the embodiment depicted, a hexagonal configuration. Preferably, cylindrical stock is milled to form the hexagonal section 37. Thus, the hexagonal section 37 has a cross section which is within the cross section of body member 30. The tipper end 36, which includes hexagonal section 37, may be engaged by a tool such as a wrench, pliers or the like to effect turning of the tool. The body member 30 further includes a circumferential slot 44 with a ring member 46 inserted therein. Slot 44 is spaced below hexagonal section 37 by a length distance 39 so that hexagonal section 37 will project above cover 20 for easy access by a distance of one to three inches. Additional slots, e.g. slot 45, may be provided to allow adjustment of the exposure of upper end 36.

A headed bolt 50 with a head 52 and a shaft 54 fits into the throughbore 34 of the body member 30. The shaft 54 of the bolt 50 projects downwardly and extends beyond the inclined surface 40 of the body member 30. A washer 56 is provided between the head 52 of bolt 50 and the top of the body member 30. The lower end 60 of the shaft 54 is threaded and it threads into a threaded passage 62 defined in a generally cylindrical wedge member 64. The generally cylindrical wedge member 64, in the preferred embodiment, has a diameter substantially equal to the diameter of the body member 30. Further, the wedge member 64 includes an inclined face or surface 66, which is in opposed relation with the face or surface 40 of the body member 30.

It is to be noted that the diameter of the shaft 54 of the bolt 50 is less than the diameter of the throughbore 34 in the body member 30. As a consequence when the bolt 50 is tightened and engages into the threaded opening 62 of the wedge member 64, the wedge member 64 and, more particularly, the inclined surface 66 engages and slides relative to the inclined surface 40 of the body member 30. The wedge member 64 will thus slide on the body member 30 and increase the effective diameter of the tool inasmuch as the wedge member 64 will project laterally beyond the cylindrical side surface of the body member 30.

The wedge member 64 further includes a knurl pattern in the outer surface thereof similar to the knurl pattern 42 of the body member 30. The knurl pattern or surface of these component parts enables the tool to tightly and frictionally engage against the inside surface of a spark plug tube when the tool is inserted, and the wedge member 64 is appropriately positioned to expand the effective diameter of the tool. The effective diameter of the tool thus becomes the maximum transverse distance or dimension from side to side of the body member 30 and wedge member 64 combined since the wedge member 64 is caused to slide against the body member 30 or, more particularly, surface 66 slides against the surface 40. The effective diameter of the tool may thus be adjusted to accommodate spark plug tubes 22 of various diameter.

The utilization of a bolt shaft 54, which is of lesser diameter than the diameter of throughbore 34 determines the limits of adjustment for the effective diameter. Preferably, the diameter of throughbore 34 is varied and lesser at upper end 36. This construction insures that the head of bolt 50 will be maintained in position and not enter the throughbore. Thus, the diameter of bolt 50 may be 0.375 inches, upper bore section 41 may be 0.405 inches, and lower bore section 43 may be 0.56 inches. The length of upper bore section 41 may be two inches. Lower bore section 43 may be about 5 inches in length. This arrangement provides adequate adjustment and movement of the wedge member 64.

Figure 4:
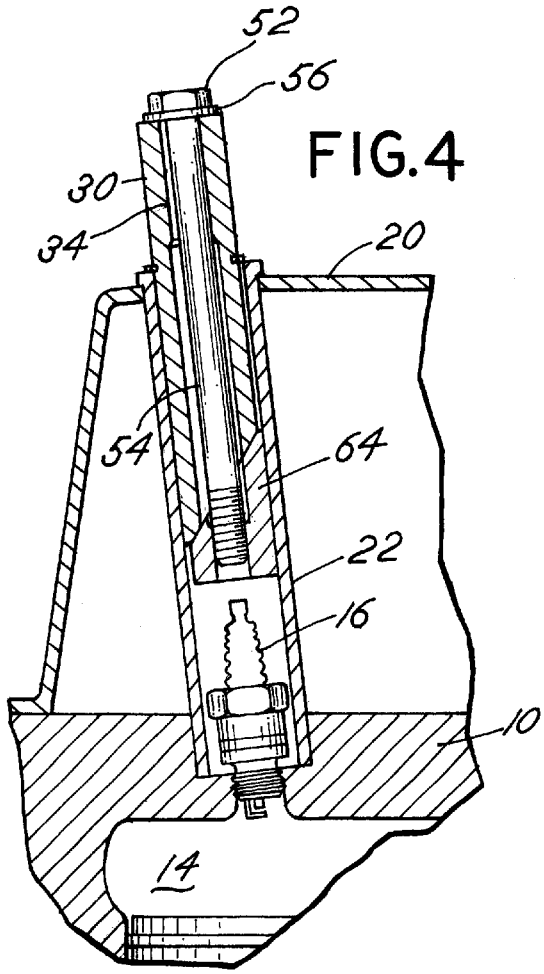
FIG. 4 illustrates the method of use of the tool of FIGS. 2 and 3 by insertion into the spark plug tube of the type depicted in FIG. 1.
Figure 3:
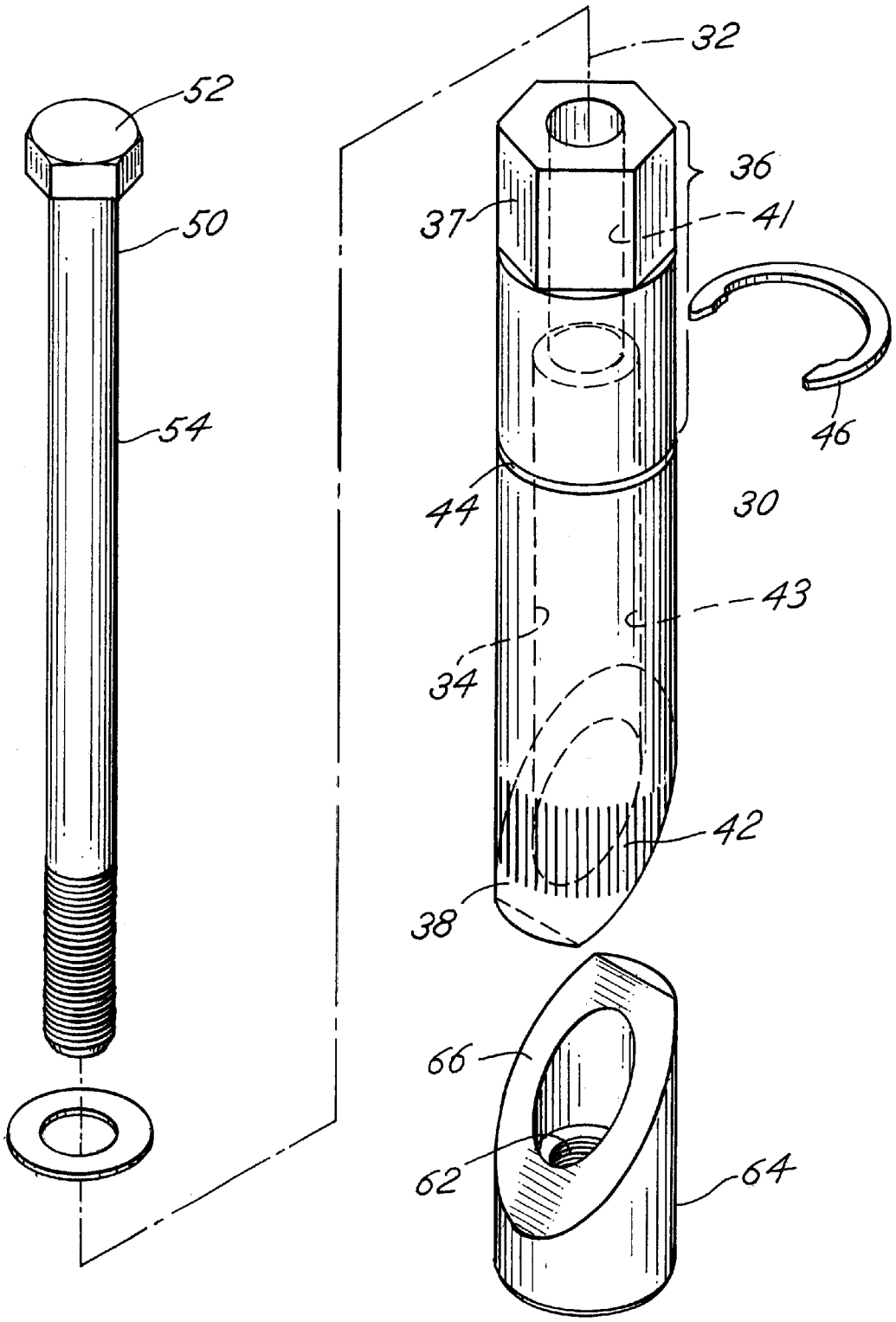
FIG. 3 is an exploded isometric view of the tool of FIG. 2.

The external C-ring 46 in groove 44 (or 45) serves as a stop upon insertion of the tool into a spark plug tube 22. Thus, as depicted in FIG. 4, the tool is inserted with the wedge member 64 extending into tube 22. Of course upon initial insertion the wedge 64 may be unthreaded or partially unthreaded as depicted in 2 to reduce the effective diameter. Upon insertion into tube 22, the stop member or C-ring 46 limits the degree of insertion. The bolt 50 is then rotated to alter the effective diameter of the tool. This causes the tool to be tightly engaged with the sides of the spark plug tube. The tool may then be rotated or pulled by engagement of a wrench or other tool with the polygonal top end 36 of the body member 30. This effects ultimate removal of the spark plug protective tube 22. Reversal of this process effects replacement of the spark plug tube 22.

Various component parts may be altered or changed without departing from the spirit and scope of the invention. For example, the use of alternative stop members 46 may be incorporated. The particular angle of inclination of the surfaces 40 and 66 may be altered. In the embodiment depicted the angles are approximately 30 to 50 degrees relative to the axis 32. The preferred embodiment utilizes an angle of 35 degrees. Variations however may be adopted without departing from the spirit and scope of the invention. The invention is therefore to be limited only by the following claims and equivalents thereof.

What is claimed is:

1. A spark plug tube removal tool comprising, in combination:

a generally cylindrical body member having a longitudinal axis, an axial throughbore, a top end and a bottom end, said bottom end comprising a surface inclined to the axis, said body member further including an external surface with a stop member adjacent the top end on said external surface to limit insertion of the body member into a spark plug tube, said stop member comprising a washer member mounted in a slot in said external surface;

a generally cylindrical wedge member having a longitudinal axis and a top end comprising a surface inclined to the wedge member longitudinal axis, said body member inclined surface and said wedge member surface inclined to the wedge member longitudinal axis in slidable, opposed relation;

and a bolt including a bolt head and a shaft with a distal threaded end, said shaft having a diameter less than the diameter of the body member throughbore whereby the shaft, when inserted in the body member throughbore, is moveable laterally, said threaded end being threadably engaged with the wedge member to axially translate the wedge member upon rotational movement of the bolt, said inclined surfaces effecting slidable movement to translate the wedge member transverse to the axis thereby increasing the effective diameter of the tool for engagement with a spark plug tube wall.

2. The tool of claim 1 wherein the outer surface of the body member and the wedge member are knurled adjacent the sliding surfaces.

3. The tool of claim 1 including a washer on the bolt shaft intermediate the head of the bolt and the body member.

4. The tool of claim 1 wherein the body member has a polygonal configuration adjacent the top end and the head of the bolt is polygonal.

5. The tool of claim 1 wherein the throughbore comprises first and second sections, said first section adjacent the top end and the second section adjacent the bottom end of said second section having a diameter greater than the diameter of the first section.

6. The tool of claim 1 including a plurality of slots in said external surface, each slot cooperative to receive said washer and thereby provide a stop member.

7. The tool of claim 1 including a polygonal section at the top end formed in cylindrical stock.

* * * * *